US010060234B2

(12) United States Patent
Robey et al.

(10) Patent No.: US 10,060,234 B2
(45) Date of Patent: Aug. 28, 2018

(54) LOW-DEBRIS LOW-INTERFERENCE WELL PERFORATOR

(71) Applicant: Halliburton Energy Services, Inc., Houston, TX (US)

(72) Inventors: Richard E. Robey, Mansfield, TX (US); Christopher C. Hoelscher, Arlington, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 288 days.

(21) Appl. No.: 15/110,279

(22) PCT Filed: Jul. 20, 2015

(86) PCT No.: PCT/US2015/041130
§ 371 (c)(1),
(2) Date: Jul. 7, 2016

(87) PCT Pub. No.: WO2017/014741
PCT Pub. Date: Jan. 26, 2017

(65) Prior Publication Data
US 2017/0145798 A1 May 25, 2017

(51) Int. Cl.
*E21B 43/117* (2006.01)

(52) U.S. Cl.
CPC ..... *E21B 43/117* (2013.01)

(58) Field of Classification Search
CPC ..... E21B 43/117; E21B 43/116; E21B 43/11; E21B 47/01; E21B 49/00; F42B 1/02;
(Continued)

(56) References Cited

U.S. PATENT DOCUMENTS 4,724,105 A * 2/1988 Owen ..... B26F 3/04 102/307
6,386,288 B1 * 5/2002 Snider ..... E21B 43/117 166/298

(Continued)

FOREIGN PATENT DOCUMENTS

CA 2271620 A1 11/2000
GB 2399583 A 9/2004
WO WO 2010/141671 A2 12/2010

OTHER PUBLICATIONS

International Search Report and the Written Opinion of the International Search Authority, or the Declaration, dated Mar. 31, 2016, PCT/US2015/041130, 10 pages, ISA/KR.

(Continued)

*Primary Examiner* — Troy Chambers
*Assistant Examiner* — Bridget A Cochran

(57) ABSTRACT

A low-debris low-interference semi-solid well perforator having selectively variable free volume and method for providing such is disclosed according to one or more embodiments. The perforator may include a charge tube holding an independently floating axial stack of selectively variable divider segments, each having one or more concavities formed in upper and lower sides. The segments are arranged so that concavities of adjacent segments form sockets, into which shaped charges are located. The segments provide support to minimize deformation of shaped charge cases yet provide less than 360 degrees circumferential contact about the shaped charges to form selectively variable voids for collecting debris and spall resulting from detonation. The voids and floating segments attenuate detonation shock interference. A debris guard prevents debris from entering the wellbore. Relieving slots in the debris guard attenuates transmission of shock interference through the debris guard.

14 Claims, 13 Drawing Sheets

(58) Field of Classification Search
CPC .... F42B 3/00; F42B 3/26; F42B 1/032; F42B 3/22; F42D 1/22; F42D 3/00; F42D 1/04; Y10T 29/49885; Y10T 29/49798; Y10T 29/49826; B21C 23/00
See application file for complete search history.

(56) References Cited

U.S. PATENT DOCUMENTS 6,460,463 B1 * 10/2002 Parrott ..... E21B 43/117 102/312
6,702,039 B2 * 3/2004 Parrott ..... B21C 1/22 102/321.1
7,084,761 B2 * 8/2006 Izumi ..... G01S 13/04 340/541
7,828,051 B2 * 11/2010 Walker ..... E21B 43/116 102/321.1
7,905,285 B2 * 3/2011 Cuthill ..... E21B 43/1195 166/297
7,980,308 B2 * 7/2011 Myers, Jr. ..... E21B 43/1195 166/297
7,984,761 B2 7/2011 Chang et al.
8,127,654 B2 * 3/2012 Williams ..... E21B 43/119 102/313
8,347,962 B2 1/2013 Sampson et al.
8,726,995 B2 * 5/2014 Bell ..... E21B 43/1195 166/297
8,807,206 B2 * 8/2014 Walker ..... E21B 43/116 166/297
2002/0134585 A1 * 9/2002 Walker ..... E21B 43/117 175/4.51
2002/0189482 A1 * 12/2002 Kneisl ..... C06B 45/10 102/306
2003/0188867 A1 * 10/2003 Parrott ..... E21B 17/05 166/297
2004/0134658 A1 * 7/2004 Bell ..... E21B 43/116 166/297
2006/0027397 A1 * 2/2006 Scott ..... E21B 43/117 175/4.6
2009/0151949 A1 * 6/2009 Marya ..... E21B 43/117 166/297
2010/0089643 A1 * 4/2010 Vidal ..... E21B 43/117 175/2
2012/0168162 A1 * 7/2012 Sampson ..... E21B 43/117 166/297

OTHER PUBLICATIONS

Tovar, et al. "Design and Evaluation of Perforation Performance Using Dynamic Under Balance—North Sea Case Histories," Society of Petroleum Engineers Annual Technical Conference and Exhibition, Sep. 19-22, 2010 (SPE 135712).

* cited by examiner

LOW-DEBRIS LOW-INTERFERENCE WELL PERFORATOR

PRIORITY

The present application is a U.S. National Stage patent application of International Patent Application No. PCT/US2015/041130, filed on Jul. 20, 2015, the benefit of which is claimed and the disclosure of which is incorporated herein by reference in its entirety.

TECHNICAL FIELD

The present disclosure relates generally to oilfield equipment, and in particular to downhole tools, drilling and related systems and techniques for drilling, completing, servicing, and evaluating wellbores in the earth. More particularly still, the present disclosure relates to an improvement in systems and methods for performing perforating operations.

BACKGROUND

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement sheath, and a short distance into the formation.

Typically, these perforations are created by a perforator. A series of shaped charges are held in a hollow steel carrier. The perforator is connected along a tool string that is lowered into the cased wellbore by a tubing string, wireline, slick line, coiled tubing, or other conveyance. Once the perforator is properly positioned in the wellbore adjacent to the formation to be perforated, the shaped charges may be detonated, thereby creating perforations through the hollow steel carrier and the desired hydraulic openings through the casing and cement sheath into the formation.

BRIEF DESCRIPTION OF THE DRAWINGS

Embodiments are described in detail hereinafter with reference to the accompanying figures, in which.

DETAILED DESCRIPTION

Figure 1:
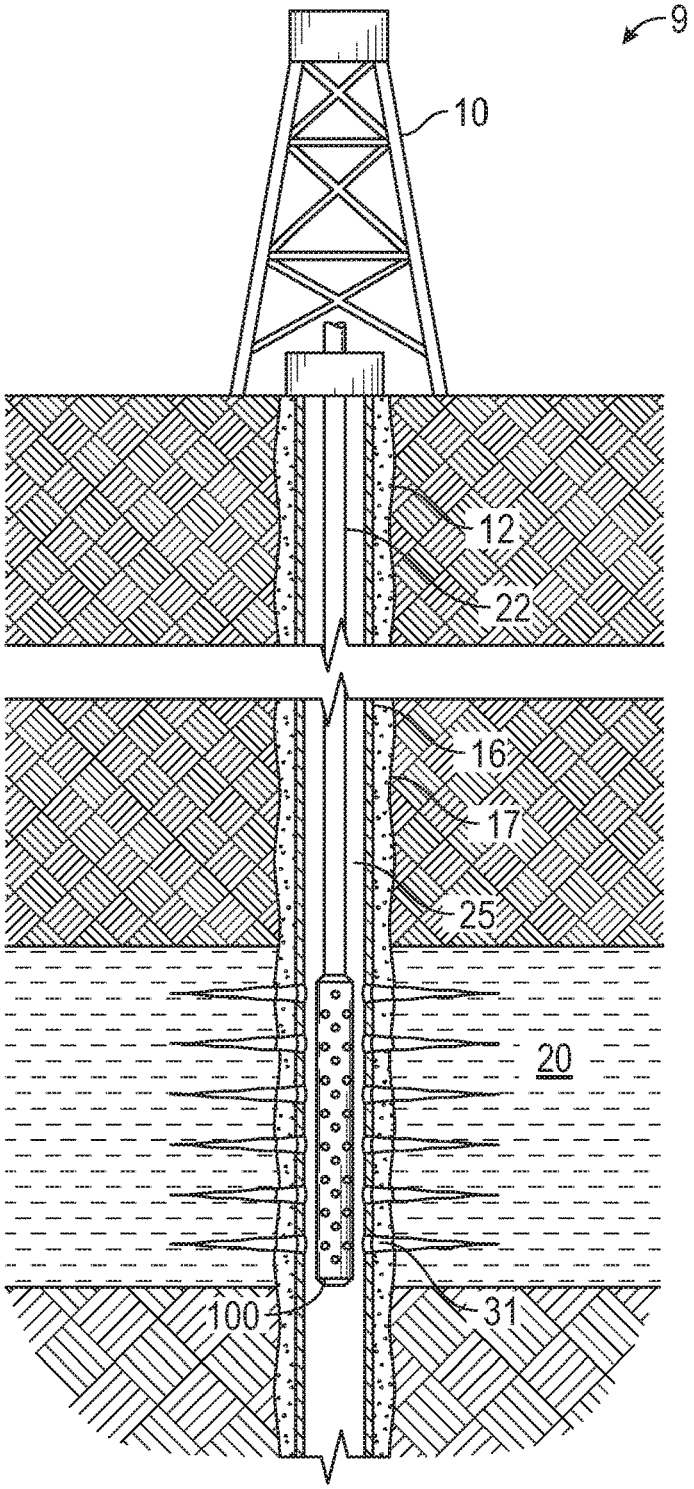
FIG. 1 is an elevation view in partial cross section of a well system with a low debris low interference well perforator according to an embodiment.

In one or more perforators, a series of shaped charges are held within a hollow thin-walled charge tube. The charge tube, with shaped charges, is disposed within a hollow steel carrier, which may have thin, recessed scallops formed in the wall that align with the shaped charges. Once the perforator is properly positioned in a wellbore adjacent to the formation to be perforated, the shaped charges may be detonated, thereby creating perforations through the recessed scallops in the hollow steel carrier and the desired hydraulic openings through the casing and cement sheath into the formation.

Each shaped charge may include an outer charge case, an explosive compound, a metal liner defining a conical void at the jet end, and a detonator at the other end. At detonation, explosive energy is released normal to the surface of the explosive compound, thereby concentrating explosive energy in the void. Enormous pressure generated by detonation of explosive compound collapses the liner and fires a high-velocity jet of metal particles outward along the axis of the shaped charge, through the carrier, wellbore casing, cement sheath, and into the formation.

Shaped charge liners may be fabricated of various materials, including ductile metals such as steel, copper, and brass. Although ductile liner materials offer deep penetration capability, they may also result in a solid slug being formed, which may plug the casing hole just perforated. Accordingly, liners may also be fabricated of unsintered cold-pressed powdered metal alloys or pseudo-alloys to yield jets that are mainly composed of dispersed fine metal particles, without solid slugs.

Despite the use of shaped charge geometry to radially focus and concentrate detonation forces in the desired outward direction, detonation of the shaped charge may still result in undesirable spalling and fracturing of the outer charge case. Debris from the outer charge case may freely spill from the free volume defined by the hollow steel carrier, via perforations formed through the carrier, into the wellbore. Large non-dissolvable solid debris from shaped charges and other perforating system components can interfere with and damage completion tools, surface equipment and the reservoir itself, result in lowered production, and require additional cleanup operations.

For this reason, some perforating systems may employ outer charge cases made of zinc. The zinc material substantially vaporizes during jet formation or by exposure to wellbore fluids, thereby minimizing production of large charge case particulate matter during perforation. However, zinc residue can create reservoir control issues due to zinc's inherent anodic behavior with wellbore fluids, resulting in fluid loss into the reservoir and subsequent required treatments of the perforated zone with kill fluids to reduce permeability.

Other perforating systems may employ a ductile solid charge tube or thick-walled charge tube in lieu of a thin-walled hollow charge tube for holding the shaped charges. The solid or thick-walled charge tube, defining a near-zero or low free volume perforator, may plastically deform to mechanically bond and consolidate with, and thereby contain, charge case fragments resulting from detonation, thus reducing the generation of debris within the wellbore.

Unfortunately, unlike a hollow thin-walled charge tube, the solid or thick-walled charge tube provides an excellent vehicle for undesirable transmission of impulses and shockwaves resulting from detonation of shaped charges throughout the perforator. That is, coupling materials in close proximity to the charge cases results in a deficit of free volume that transfers explosively generated shocks from charge to charge. This shockwave transmission from detonation of one or more shaped charges within a perforator may cause interference with the proper detonation of subsequent shaped charges within the perforator. Shock interference may be detrimental to jet formation and performance, resulting in degrading hole size or even burst casing.

The present specification discloses a well perforator, system, and method according to one or more embodiments that maintains the performance of a traditional high-energy steel-cased shaped charges yet provides the advantageous properties of a low-debris perforator that minimizes post-perforating solids accumulation within the wellbore by containing debris within the perforator. By introducing various voids and discontinuities, the perforator according to the present specification diminishes explosive interference between shaped charges during detonation.

The disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. Various items of equipment, such as fasteners, fittings, etc., may be omitted to simplify the description. However, routineers in the art will realize that such conventional equipment can be employed as desired.

FIG. 1 is an elevation view in partial cross-section of a well system, generally designated 9, according to an embodiment. Well system 9 may include drilling, completion, servicing, or workover rig 10. Rig 10 may be deployed on land or used in association with offshore platforms, semi-submersibles, drill ships and any other system satisfactory for drilling, completing, or servicing a wellbore 12. Rig 10 may include a hoist, rotary table, slips, elevator, swivel, and/or top drive (not illustrated) for assembling and running a working string 22. A blow out preventer, christmas tree, and/or and other equipment associated with servicing or completing a wellbore (not illustrated) may also be provided.

Wellbore 12 may extend through various earth strata into a first hydrocarbon bearing subterranean formation 20. A portion of wellbore 12 may be lined with a casing string 16, which may be joined to the formation with casing cement 17. In some embodiments, working string 22, extending from the surface, may be positioned within wellbore 12. The term working string, as used herein broadly encompasses any conveyance for downhole use, including drill strings, completion strings, evaluation strings, other tubular members, wireline systems, and the like. Working string 22 may provide an internal flow path for workover operations and the like as appropriate. An annulus 25 may be formed between the exterior of working string 22 and the inside wall of wellbore 12 or casing string 16.

According to one or more embodiments, working string 22 may carry a low-debris low-interference well perforator 100. Perforator 100 may be designed and arranged to creating openings 31 through casing 16, casing cement 17, and into surrounding formation 20 for fluid communication between formation 20 and the interior of casing 16. As described in greater detail hereinafter, perforator 100 is characterized by a semi-solid geometry that decouples charge interaction by inducing discontinuities, or voids, which may be located proximal to shaped charges, to allow for controlled expansion of material and provide a torturous path for high-pressure high-velocity shockwaves to propagate during detonation. The semi-solid geometry may be formed by a longitudinal stack of disconnected divider segments that decouple and minimize transmission of axial shock interference.

Figure 2:
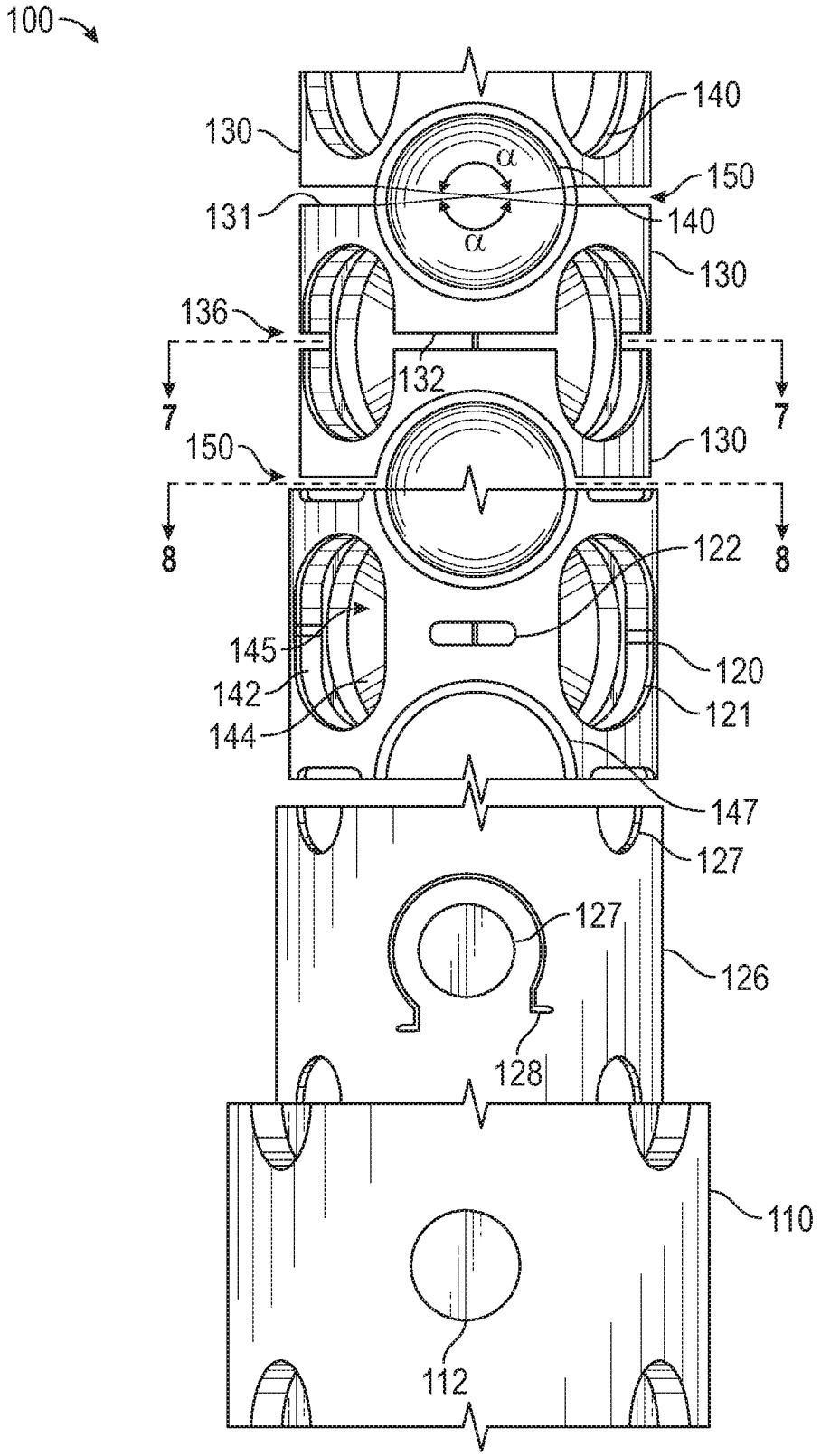
FIG. 2 is an elevation view of a portion of the perforator of FIG. 1 according to an embodiment, showing a longitudinal stack of divider segments forming sockets for shaped charges, a charge tube, and a debris guard received within a cylindrical carrier.

FIG. 2 is an elevation view of a low debris well perforator 100 according to one or more embodiments. Perforator 100 may be assembled in a cylindrical carrier 110 made from a length of straight wall tubing, preferably high strength steel. Any style of hollow carrier 110 specified for a particular wellbore application may be used as appropriate. Carrier 110 may have gun ports, or thin-wall recessed areas, often referred to as scallops, 112 radially and axially aligned with shaped charges 140 supported within carrier 110. Each shaped charge 140 may include an outer charge case 142, an explosive compound 143 (FIG. 9), a metal liner 144 defining a conical void 145 at the jet end, and an explosive booster 146 (FIG. 9) at the other end. Each shaped charge 140 may define an outer circumferential flange 147 (FIG. 6) at the jet end.

In one or more embodiments, shaped charges 140 and scallops 112 may be arranged in a linear configuration along the longitudinal length of carrier 110 of perforator 100, while in other embodiments, shaped charges 140 and scallops 112 may be arranged in a helical configuration about carrier 110. For example, well perforator 100 of FIG. 2 includes a treble helical arrangement, with three helical rows of shaped charges spaced 120 degrees apart, rotating 60 degrees per step.

Shaped charges 140 may be selectively and individually detonatable, so that only those shaped charges 140 facing in a single select radial direction may be detonated if desired. In one or more embodiments, perforator 100 may include multiple groupings of shaped charges 140, wherein each grouping may be selectively and individually detonatable. However, perforator 100 described herein is not limited to a particular type of arrangement, and the forgoing general comments are provided for illustrative purposes only.

According to one or more embodiments, perforator 100 may include a plurality of divider segments 130, a thin-walled charge tube 120, and an outer debris guard 126. Divider segments 130, charge tube 120, and outer debris guard 126 may be disposed within carrier 110 so as to align shaped charges 140 with scallops 112. Divider segments 130 may be arranged in a free-floating longitudinal stack within charge tube 120. Shaped charges 140 may be partially supported between pairs of divider segments 130, as described in greater detail hereinafter. In one or more embodiments, debris guard 126 may be a thin-walled tubular member, charge tube 120 may be coaxially received within debris guard 126, and debris guard 126 may be coaxially received within carrier 110.

Figure 3:
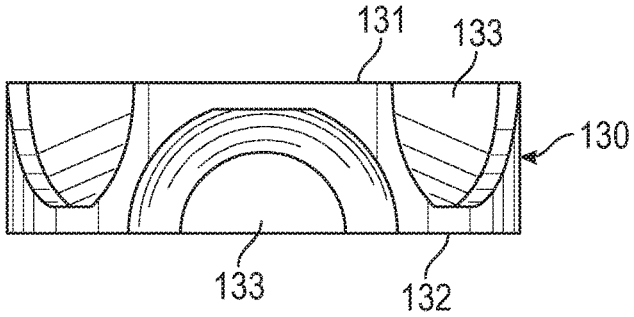
FIG. 3 is an elevation view of a divider segment of FIG. 2 according to an embodiment.
Figure 4:
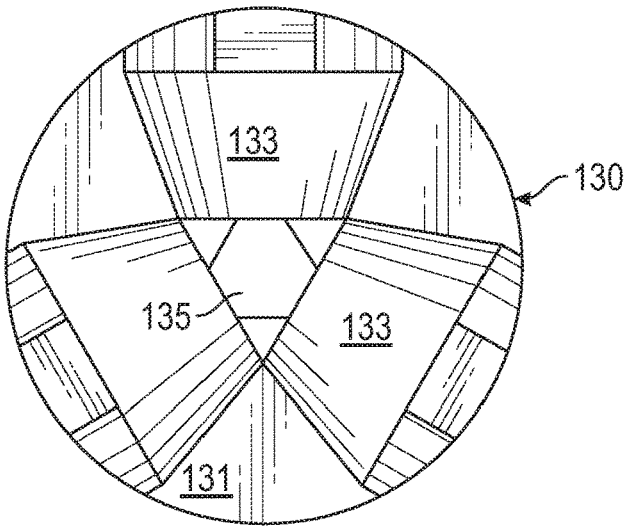
FIG. 4 is a plan view of the divider segment of FIG. 3, showing a generally planar top surface with three concavities radially formed therein.
Figure 5:
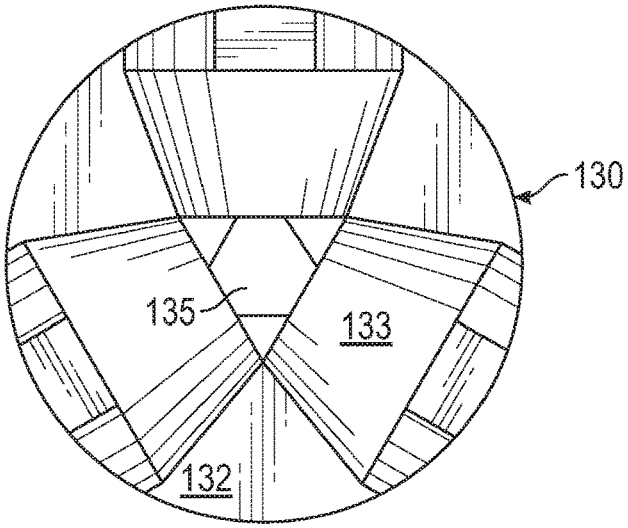
FIG. 5 is a plan view of the divider segment of FIG. 3, showing a generally planar bottom surface with three concavities radially formed therein and offset from the concavities of FIG. 4.
Figure 6:
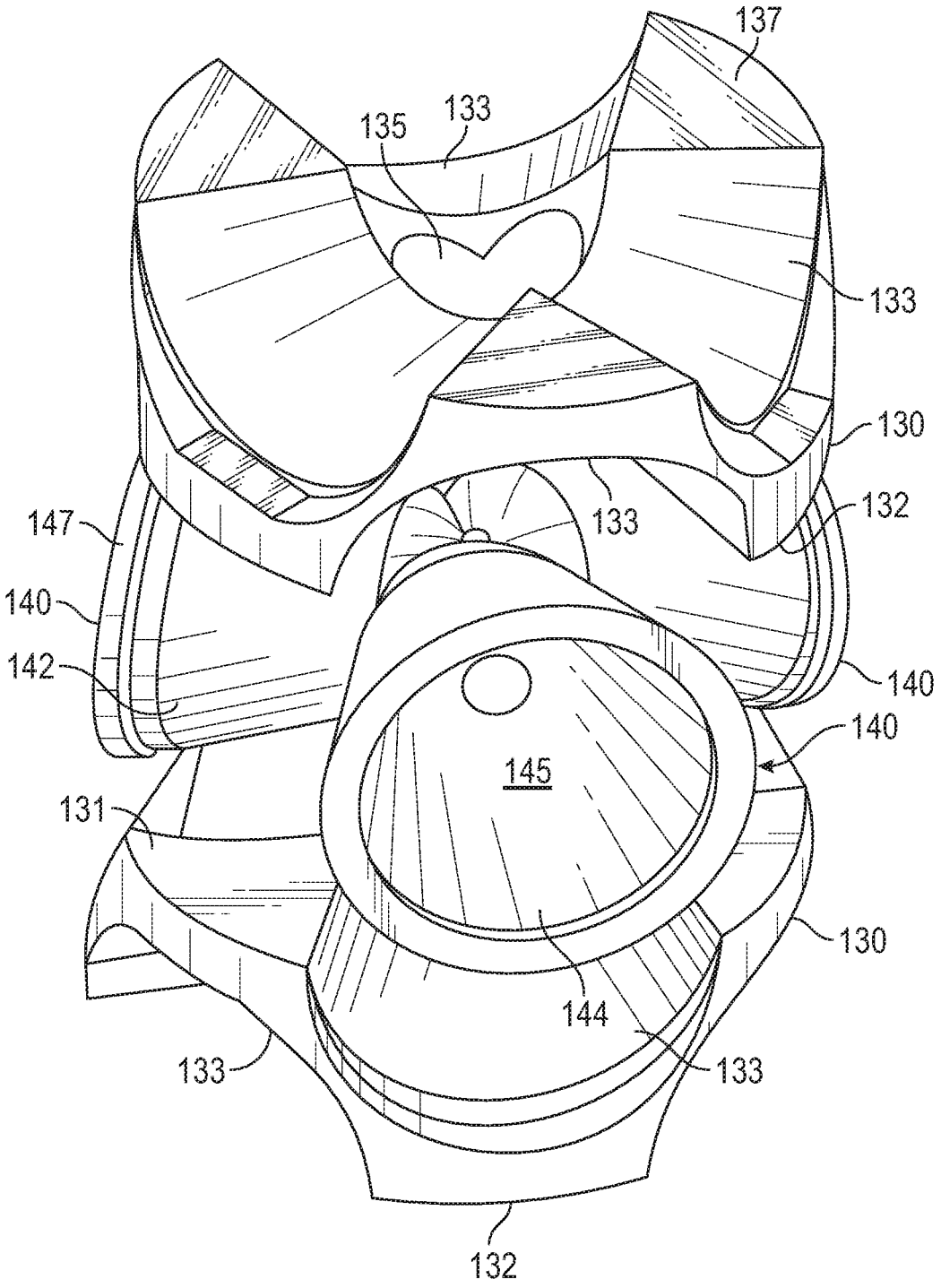
FIG. 6 is an exploded perspective view of two divider segments of FIG. 3 and three shaped charges partially supported within the concavities of the divider segments.

FIG. 3 is an elevation view of a single divider segment 130 according to one or more embodiments. FIGS. 4 and 5 are top and bottom plan views, respectively of divider segment 130 of FIG. 3. FIG. 6 is an exploded perspective view of two divider segments 130 supporting three shaped charges. Referring to FIGS. 2-6, shaped charges 140 may be carried between pairs of divider segments 130, which may in turn be axially arranged within charge tube 120 and outer debris guard 126.

Divider segments 130 may be formed of a solid material, such as steel, aluminum, or plastic, although other suitable solid materials, both metallic and nonmetallic, may be used as appropriate, including low density materials such as foam, rubber, and aerogel. Divider segments may be formed by machining, casting, welding, molding, sintering, or 3-D printing, although other suitable manufacturing techniques may be used. Divider segments may formed with internal pores or include encapsulated liquid, powder, sand, salt, concrete, micro-balloons, or microspheres, for example.

Each divider segment 130 may include one or more concavities 133. Divider segments 130 are arranged so that concavities 133 of adjacent divider segments 130 align to form sockets 136 into which shaped charges 140 are received. According to one or more embodiments, each divider segment 130 defines generally planer top and bottom sides 131, 132. Top side 131 and bottom side 132 may each include one or more concavities 133. Each concavity 133 may have an approximately semi-cylindrical, semi-conical, semi-frustoconical, or similar shape dimensioned to accommodate an upper or lower portion of a shaped charge 140. In one or more embodiments, concavities 133 formed in bottom side 132 may be radially offset from and intervaled between concavities 133 formed in top side 131. The number of concavities 133 per divider segment may vary. In the embodiment illustrated in FIGS. 2-6, three concavities 133, radially spaced 120 degrees apart, are provided in each top side 131 and bottom side 132. An axial opening 135 may be formed through divider segment 134, for accommodating a detonation means 149 (FIG. 7) for shaped charges 140.

Figure 7:
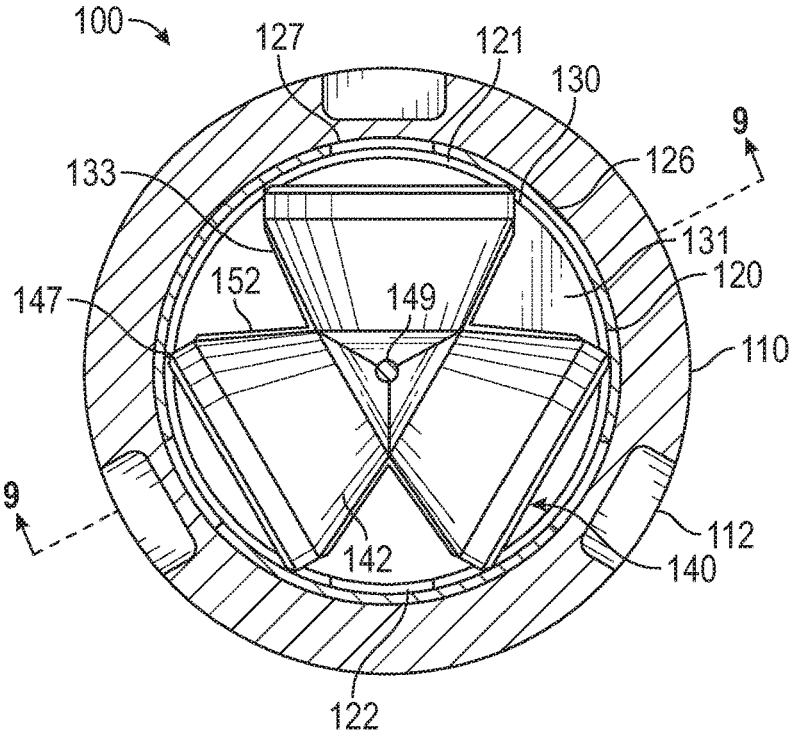
FIG. 7 is a transverse cross-section taken along lines 7-7 of FIG. 2.
Figure 8:
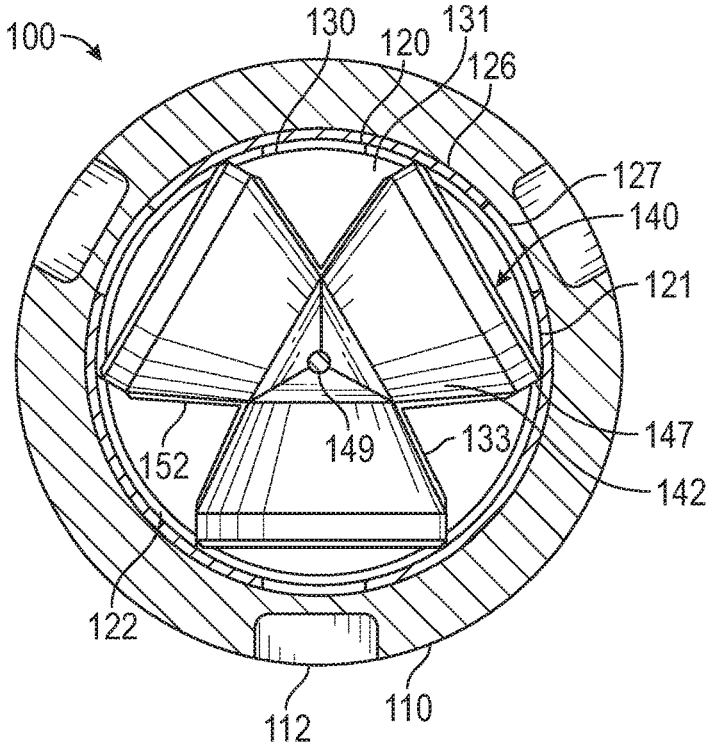
FIG. 8 is a transverse cross-section taken along lines 8-8 of FIG. 2.
Figure 9:
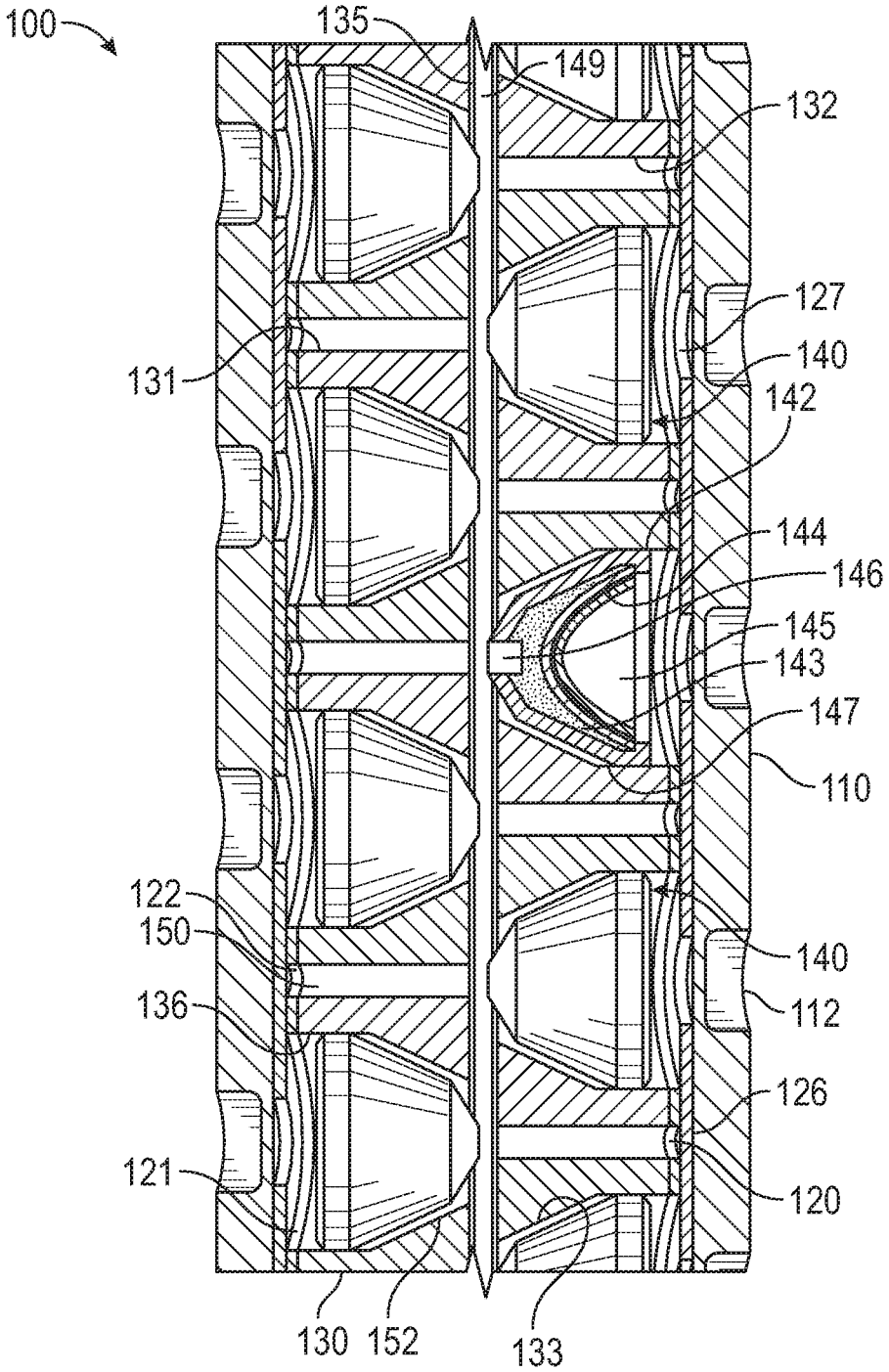
FIG. 9 is an axial cross-section taken along lines 9-9 of FIG. 7.

FIGS. 7 and 8 are transverse cross-sections taken along lines 7-7 and 8-8 of FIG. 2, respectively. FIG. 9 is an axial cross-section taken along lines 9-9 of FIG. 7. Reference is now made to FIGS. 2 and 7-9.

As best seen in FIGS. 2 and 9, each concavity 133 may be dimensioned so as to provide an angle $\alpha$ less than 180 degrees of circumferential support about outer flange 147 of the adjacent shaped charge 140. Accordingly, two adjacent divider segments 130 may support outer flanges 147 of one or more shaped charges 140 with less than 360 degrees of overall circumferential outer flange contact thereby resulting in one or more transverse voids 150 being extant between top and bottom sides 131, 132 of adjacent divider segments 130. That is, divider segments 131 of perforator 100 have no direct contact with one another prior to detonation of shaped charges 140. Transverse voids 150 allow room for controlled expansion of the outer charge case 142 and collection and recombination of debris and spall material during detonation of shaped charges 140, as described in greater detail hereinafter. Accordingly, transverse voids 150 may be termed as spall compartments. Although voids 150 may be oriented transversely to the axis of perforator 100, in one or more embodiments, voids 150 may be oriented along an acute angle with respect to the axis of perforator 100.

The selection of angle $\alpha$ of shaped charge support provided by divider segment 130 may vary depending on various factors including perforator diameter, manufacturing tolerances, the materials used to form divider segments 130, charge tube 120, outer debris guard 126 and gun body 110, and the caliber and ballistic characteristics of shaped charges 140. In one or more embodiments, divider segments 130 may be separated from one another by void 150 thickness of at least 0.020 inches, although other separation dimensions may be appropriate and are included within the scope of the disclosure.

As best seen in FIGS. 7-9, shaped charges 140 are supported at outer flanges 147 by divider segments 130. Concavities 133 may be dimensioned to result in small conical or similarly-shaped shaped charge voids 152 surrounding substantial portions of shaped charges 140. Shaped charge voids 152 allow room for controlled expansion of the outer charge case 142 and collection and recombination of debris and spall material during detonation of shaped charges 140, as described in greater detail hereinafter. The dimension and shape of concavities 133 of divider segments 130 may be varied to provide an appropriate volume of shaped charge voids 152 so that upon detonation, voids 152 become substantially filled with unconsolidated material. In one or more embodiments, the nominal distance between shaped charge outer case 142 and the interior surface of concavity 133 may be about 0.060 inches, although other separation dimensions may be appropriate and are included within the scope of the disclosure.

Charge tube 120 provides a frame for assembling divider segments 130 and shaped charges 140 and for ballistically connecting the explosive booster 146 of shaped charges 140 with a detonation system 149. In one or more embodiments, detonation system 149 does not rely on any means of ballistically coupling or transferring the detonation train between shaped charges 140. Charge tube 120 may include a plurality of gun port apertures 121 formed therethrough in radial and axial alignment with shaped charges 140 and scallops 112. The outer diameter of gun port apertures 121 may substantially match the outer diameter of outer flanges 147 of shaped charges 140 to allow installation and servicing of shaped charges 140.

Additionally, charge tube 120 may include a plurality of debris slots or other openings 122 formed therethrough. In one or more embodiments, debris slots 122 may be located 180 degrees opposite gun port apertures 121. Debris slots 122 axially align with transverse voids 150 and provide additional volume for reconsolidation of spall material and other debris during detonation of shaped charges 140. Moreover, debris slots 122 provide additional shock relief geometry to charge tube 120 for attenuating axial shock transmissions from detonation. The size and shape of debris slots 122 may be varied depending on the reconsolidation volume required. In one or more embodiments, the dimension of debris slots 122 may range between ¼ and ¾ of the ballistic caliber of shaped charge 140, although other sizes may be used as appropriate.

In one or more embodiments, as illustrated in FIGS. 2 and 7-9, debris guard 126 may be a thin-walled cylindrical tube. Charge tube 120 may be disposed within debris guard 126 within close radial tolerances. An inner surface of debris guard 126 may be in close proximity or in contact with the outermost portion of charge case 142, thereby functioning to retain shaped charges 140 within charge tube 120. Debris guard 126 may in turn be disposed within carrier 110 within close radial tolerances. Debris guard 126 may include gun port apertures 127 formed therethrough in radial and axial alignment with shaped charges 140, gun port apertures 121, and scallops 112. Gun port apertures 127 may have a diameter about the same as recessed scallops 112 of carrier 110, although other diameters may also be used.

Debris guard 126 may include relieving cuts or slots 128 formed therethrough, which may partially surround gun port apertures 127. Relieving slots 128 may provide disruption or redirection of shock waves that may otherwise travel through along debris guard 126 during detonation of shaped charges 140. The geometry of relieving slots 128 may vary as appropriate.

Debris guard 126 covers debris slots 122 of charge tube 120, preventing debris and spall collecting in debris slots 122 from exiting perforator 100 and collecting in wellbore 12 (FIG. 1). Further, debris guard 126 provides a tortuous path for pressures generated within perforator 100 to escape into the wellbore via debris slots 122, the high-tolerance annular region defined between charge holder 120 and debris guard 126, and one or more perforated scallops 112.

In one or more embodiments, not expressly illustrated, multiple debris guard sleeves may be coaxially provided in lieu of a single debris guard 126. Such sleeves may be made from steel, aluminum, magnesium, plastic, foam, rubber, or other suitable materials. The multiple debris guard sleeves may have complementary or phased offset discontinuities to mitigate shock wave propagation. For example, the sleeves may formed of discrete strips having a geometry with directionally non-continuous tortuous path facets, such as zigzag, saw-tooth or wave patterns. The sleeves may also be cut to promote loading along rows, in short strip lengths, sections, or a combination thereof. The sleeves may include relieving slots similar to relieving slots 128, which may be arranged perpendicular to the axis of perforator 100. Similar, to debris slots 122 and debris guard relieving slots 128, relieving slots in multiple guard sleeves may be positioned so as not to overlap thereby creating a more complex and tortuous labyrinth for fluid communication between perforator 100 and wellbore 12 (FIG. 1).

Additionally, in one or more embodiments, not expressly illustrated, debris guard 126 may take the form of one or more longitudinal strips disposed between charge tube 120 and carrier 110 so as to cover debris slots 122. The strips may be seated within longitudinal grooves formed along the outer surface of charge tube 120, the inner surface of carrier 119, or both, thereby preventing debris and spall collecting in debris slots 122 from exiting perforator 100 while providing a tortuous path for pressures generated within perforator 100 to escape into the wellbore. Similar, to debris slots 122 and debris guard relieving slots 128, relieving slots in multiple guard strips may be positioned so as not to overlap thereby creating a more complex and tortuous labyrinth for fluid communication between perforator 100 and wellbore 12 (FIG. 1).

Charge tube 120 provides a frame for assembling and positioning a longitudinal stack of divider segments 130. In one or more embodiments, divider segments 130 may be free floating, i.e., they are neither rigidly fastened to one another, to charge tube 120, nor to debris guard 126. Such a longitudinally independent arrangement may diminish detonation shock interference. Divider segments 130, charge tube 120, and debris guard 126 together provide a minimal support to outer charge cases 142 of shaped charges 140, while none independently fully seat, house or retain shaped charges 140. Divider segments 130, charge tube 120, and debris guard 126 may be assembled so that minimal radial clearances are held, whereupon detonation, expansion of each of these components resulting from internal detonation pressures are supported by adjacent components.

Figure 10:
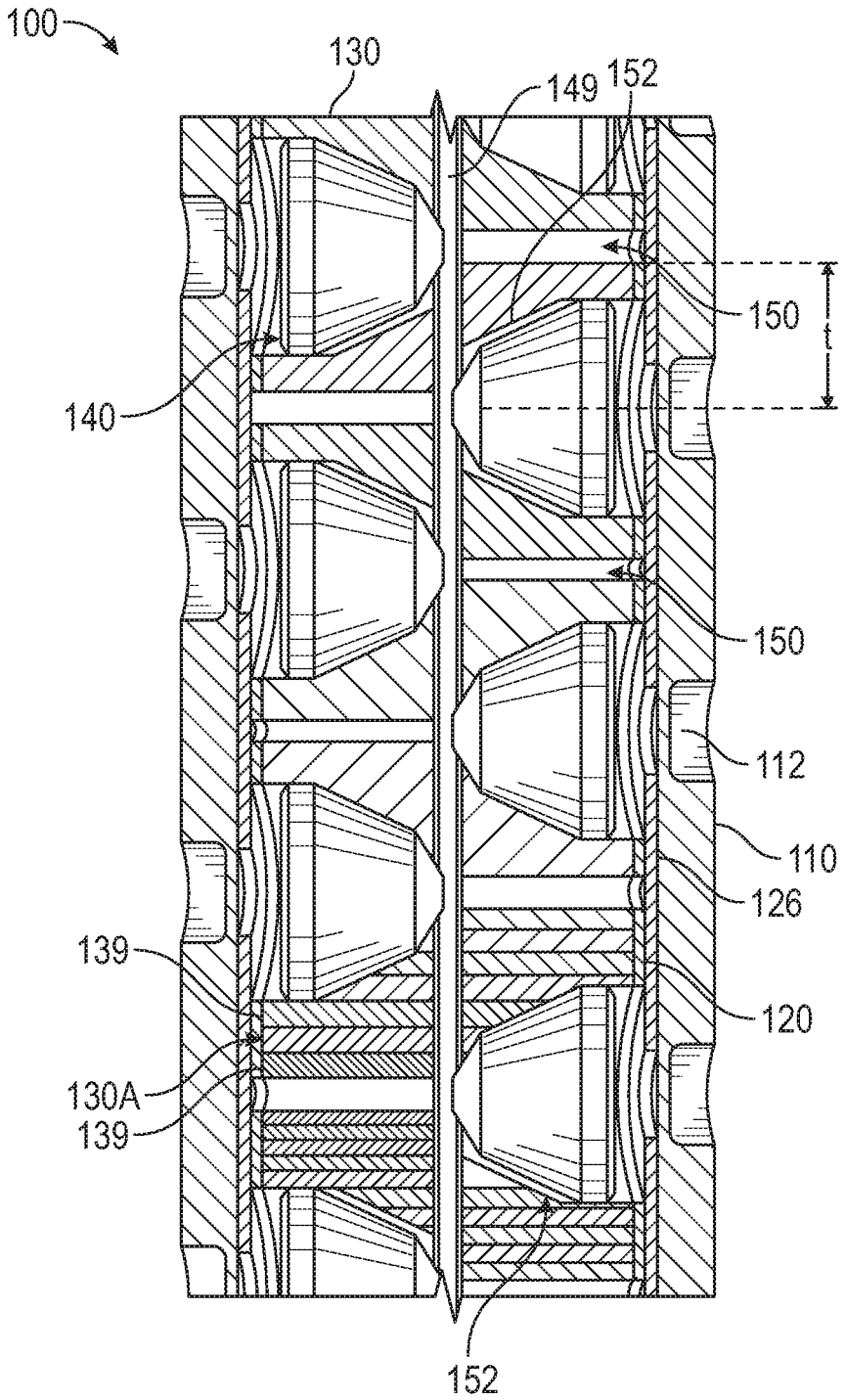
FIG. 10 is an axial cross-section of a portion of the perforator of FIG. 1 according to one or more embodiments, showing designed variability in the geometry of divider segments resulting in the ability to finely tune the amount of free volume within the perforator.

FIG. 10 is an axial cross-section that illustrates various embodiments of perforator 100. The overall axial thickness t of each divider segment 130 may be varied, depending on the specific needs of wellbore 12 (FIG. 1). For example, the overall axial thickness t may range between 0.25 and 3.0 inches, although other thicknesses t may also be provided.

Moreover, the geometry of each divider segment 130 may be varied, depending on the specific needs of wellbore 12 (FIG. 1). By varying the geometry of divider segments 130, the volume of transverse voids 150 and shaped charge voids 152 may be controlled, thereby allowing the operator to easily select an overall desired free volume of perforator 100. In other words, perforator 100 may provide a fine resolution in varying the free volume of perforator 100 along a sliding scale from a minimum free volume to a maximum free volume. For example, over the length of a 6.75 inch diameter 16 foot long perforator, there may be as many as eighty-seven divider segments 130 in a particular configuration, allowing nearly infinite variability of designed free volume along a perforating interval. Thick divider segments 130, thin divider segments 130, or a combination of thick and thin divider segments 130, may be used in a given perforator 100. Thick or thin transverse voids 150, or a combination thereof, may be provided in a given perforator 100. And, large or small shaped charge voids 152, or a combination thereof, may be provided in a given perforator 100.

Moreover, as shown in FIG. 10, divider segments 130 need not be unitary or homogeneous. For example, a divider segment 130A may be formed of a longitudinal stack of disks or plates 139, a coaxial arrangement of sleeves (not illustrated), or other suitable arrangement, which may further promote creation of spall and attenuation of undesired fragmentation forces. Each disk 139 may define a discontinuity volume to reduce shock wave transmission.

Figure 11:
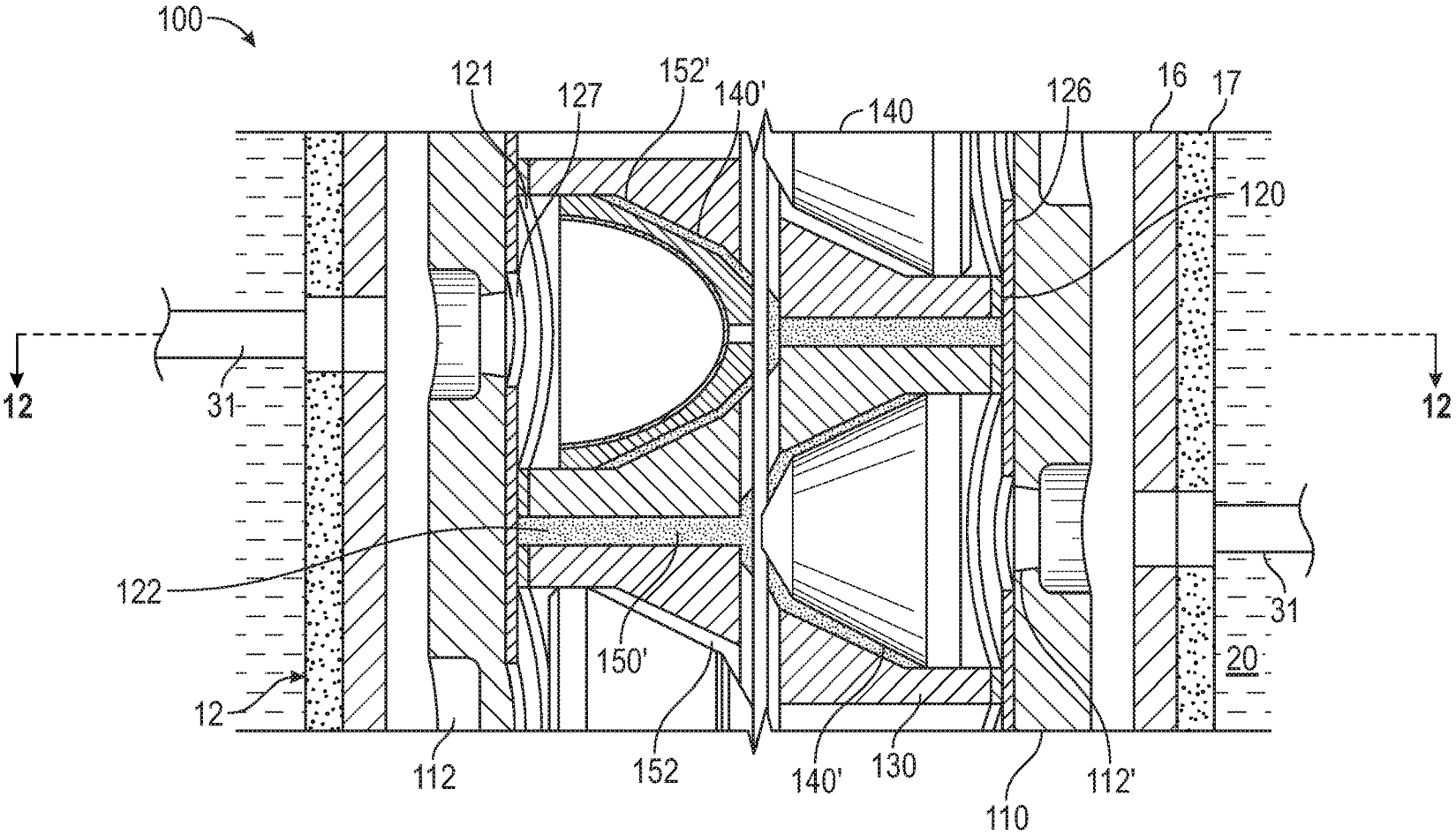
FIG. 11 is an enlarged axial cross-section of a portion of the perforator of FIG. 9 after one or more shaped charges have been detonated.
Figure 12:
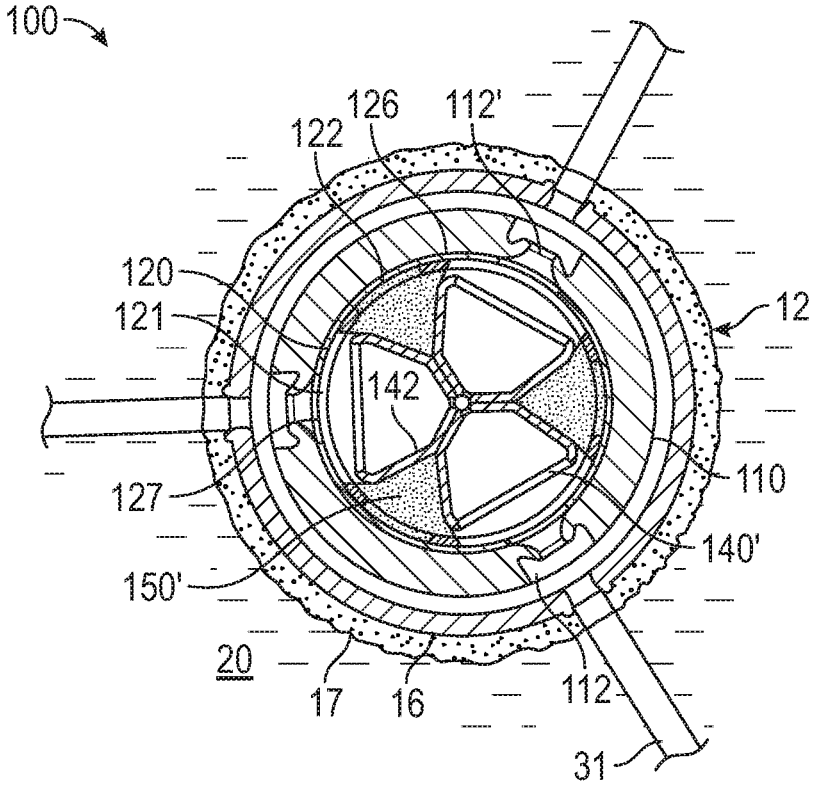
FIG. 12 is a transverse cross-section of the perforator of FIG. 11 taken along lines 12-12 of FIG. 11.

A theory of operation of perforator 100 is now described with references to FIGS. 11 and 12, which illustrate perforator 100 after a number of shaped charges 140 have been detonated (indicated by reference numeral 140'). Divider segments 130 surround charge cases 142 with a solid material, thereby substantially preserving the structural integrity of outer charge cases 142 and minimizing the generation of debris that would otherwise occur with free volume detonation. Divider segments 130 are arranged provide a predetermined empty volume—voids 150, 152—for material consolidation and dampening of detonation shock propagation.

Shock attenuation or dampening occurs when a shock wave crosses a void between adjacent divider segments 130. When a compression wave meets a free surface, it will continue on and into the void. Propagation of this wave across the free surface creates a tensile wave on the boundary of a divider segment 130. Simultaneously, a compression wave is reflected backwards. Both the forward transmitted wave and the reflected wave are lower in magnitude than the shock initial wave. The tensile wave acting on the free surface may have a tendency pull material off as it moves across the void, producing spall. Divider segments 130 may also provide a source of spall from detonation events.

Transverse voids 150 and shaped charge voids 152 may be initially evacuated or filled with a gas, such as air, nitrogen, argon, carbon dioxide, or the like. Divider segments 130 allow for controlled expansion and support of outer charge cases 142, and transverse voids 150 and shaped charge voids 152 collect and reconsolidate debris and spall (indicated by reference numerals 150', 152'). In one or more embodiments, perforator 100 may be sized and dimensioned so that non-contact spacing between adjacent divider segments 130 and between shaped charge outer cases 142 and divider segments 130 are filled and become substantially solid after detonating shaped charges 140. All the components of perforator 100 may be assembled so that minimal radial clearances are held whereupon detonation, each components subject to expansion from the internal pressure is supported by adjacent components. Charge tube 120 and debris guard 126 retain debris and spall within perforator 100.

Perforator 100 also provides a tortuous path for high pressures and high velocity shock waves to travel. Independently floating divider segments 130 providing transverse and shaped charge voids 150, 152 break the continuity of a fully solid perforator system and thereby serve to dampen shock wave transmission. Moreover, debris slots 122 formed within charge tube 120 and relieving slots 128 may disrupt and redirect axial shock wave propagation. Detonation pressures may be relieved into wellbore 12 via a tortuous flow path through transverse void 150, debris port 122, the annular region between debris guard 126 and charge tube 120, and perforations 112', formed in carrier 110.

Figure 13:
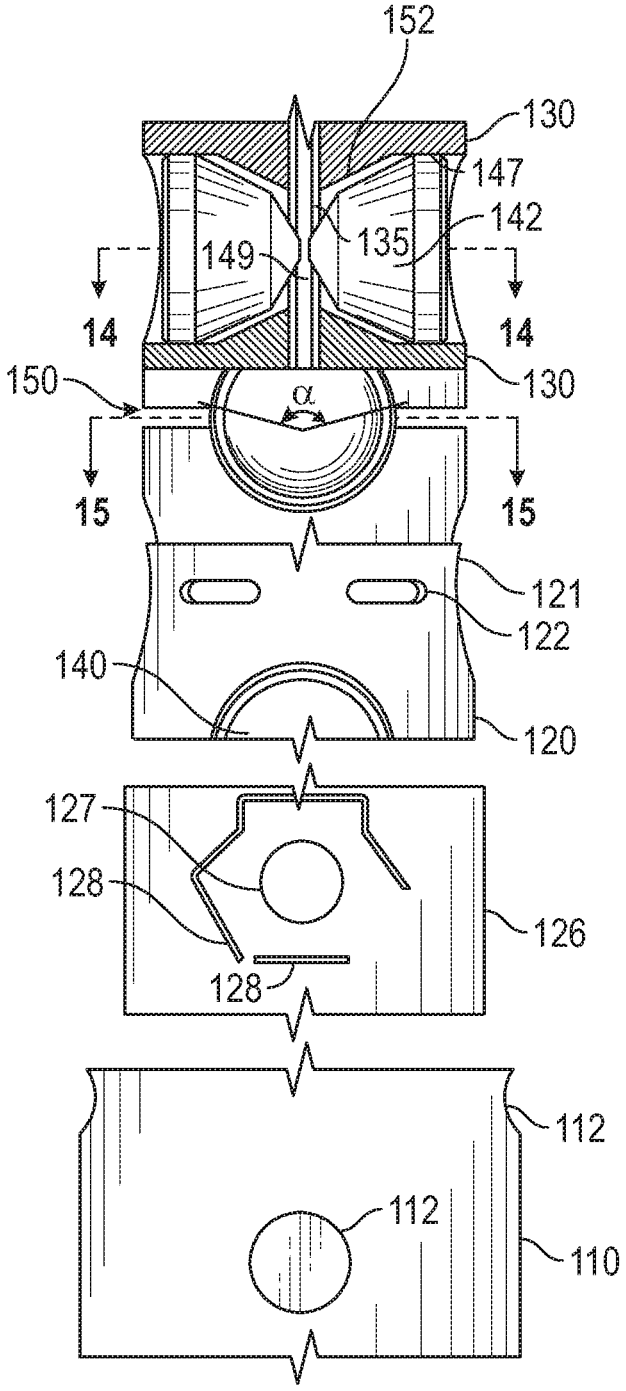
FIG. 13 is an elevation view in partial cross-section of a portion of the perforator of FIG. 1 according to an embodiment, showing a longitudinal stack of divider segments forming sockets for shaped charges, a charge tube, and a debris guard received within a cylindrical carrier.
Figure 14:
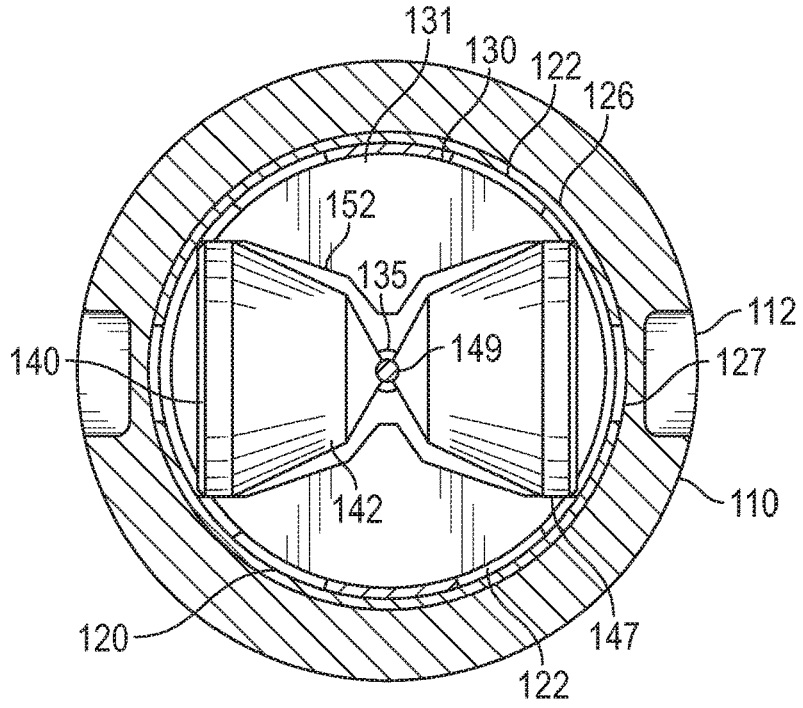
FIG. 14 is a transverse cross-section of the perforator of FIG. 13 taken along lines 14-14 of FIG. 13.
Figure 15:
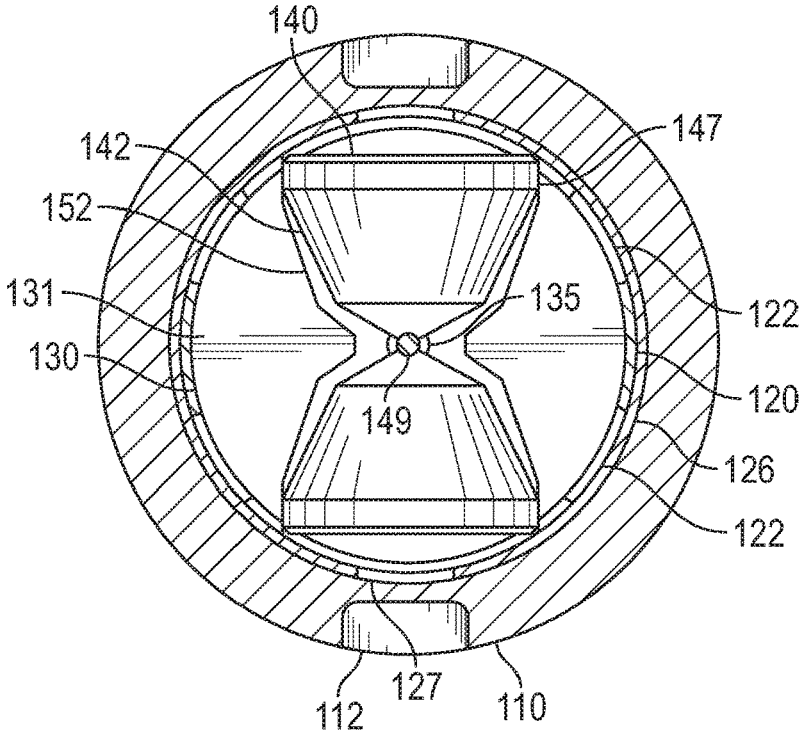
FIG. 15 is a transverse cross-section of the perforator of FIG. 13 taken along lines 15-15 of FIG. 13.

As noted above, perforator 100 may include shaped charges 140 in numerous arrangements. FIGS. 2-12 illustrate one or more embodiments in which shaped charges are positioned at intervaled 120 degree spacing. Referring now to FIGS. 13-15, a perforator 100 with intervaled 180 degree-spaced shaped charges 140 is disclosed according to one or more embodiments. Similarly, as disclosed in FIGS. 16 and 17, a perforator 100 having a single helical arrangement shaped charges 140 may allow for a non-centralized perforation system. Perforators 100 of FIGS. 13-17 may have essentially the same arrangement, features and theory of operation as perforator 100 of FIGS. 2-12 and are therefore, for the sake of brevity, not described in further detail. Reference may be made to the previous disclosure, in which like numerals designate like parts.

Figure 16:
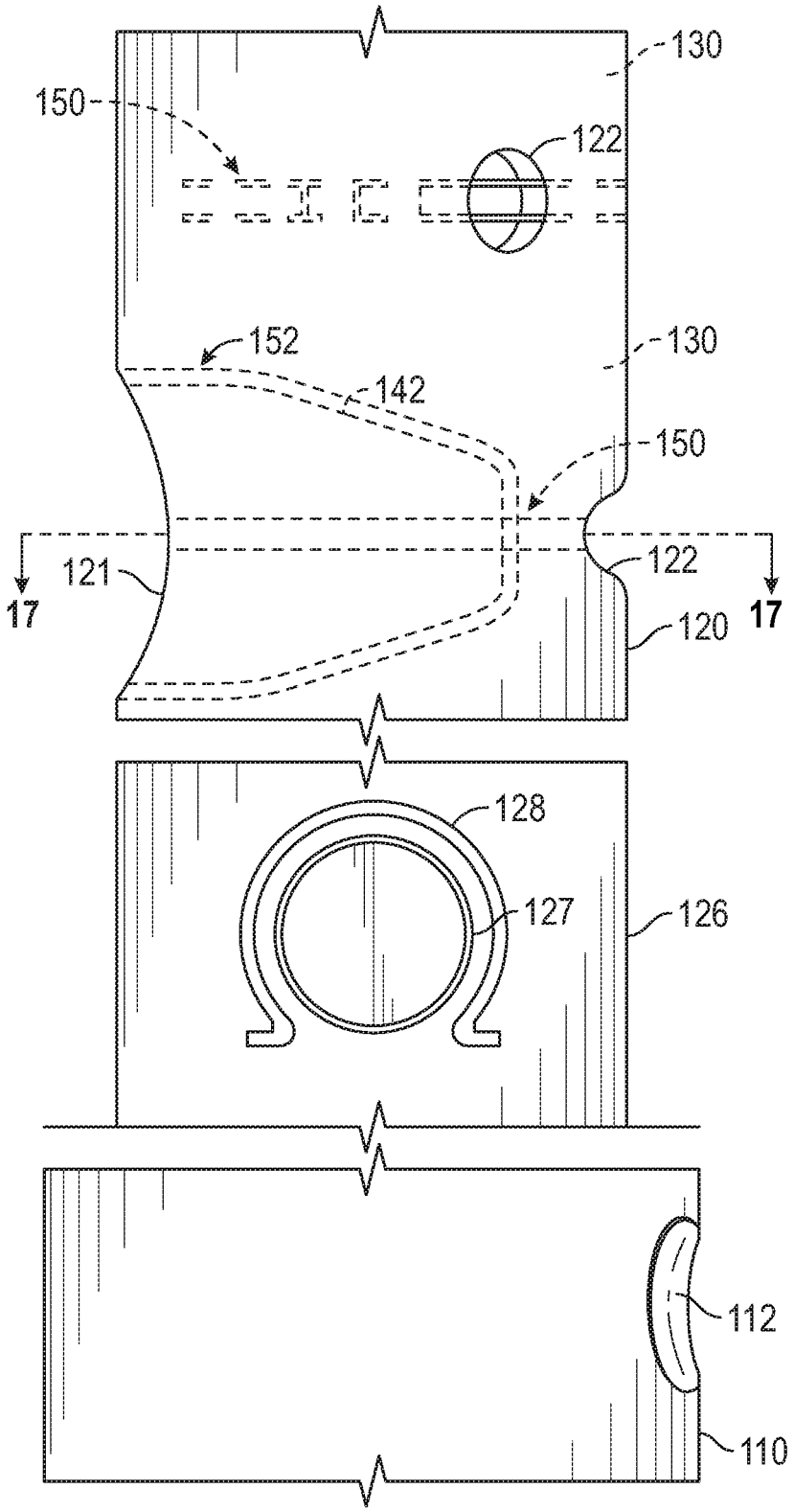
FIG. 16 is an elevation view of a portion of the perforator of FIG. 1 according to an embodiment, showing a single helical shaped charge arrangement with a non-centralized detonation arrangement.
Figure 17:
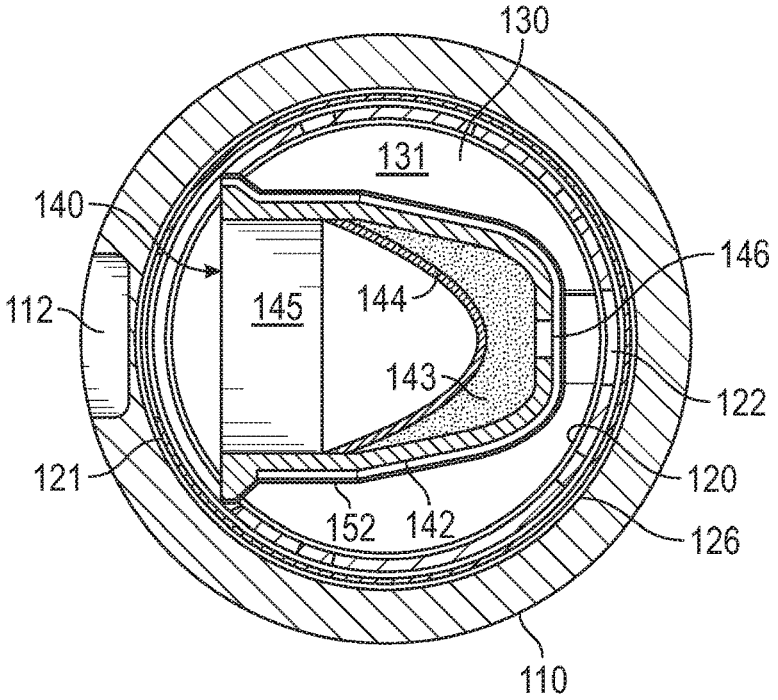
FIG. 17 is a transverse cross-section of the perforator of FIG. 16 taken along lines 17-17 of FIG. 16.
Figure 18:
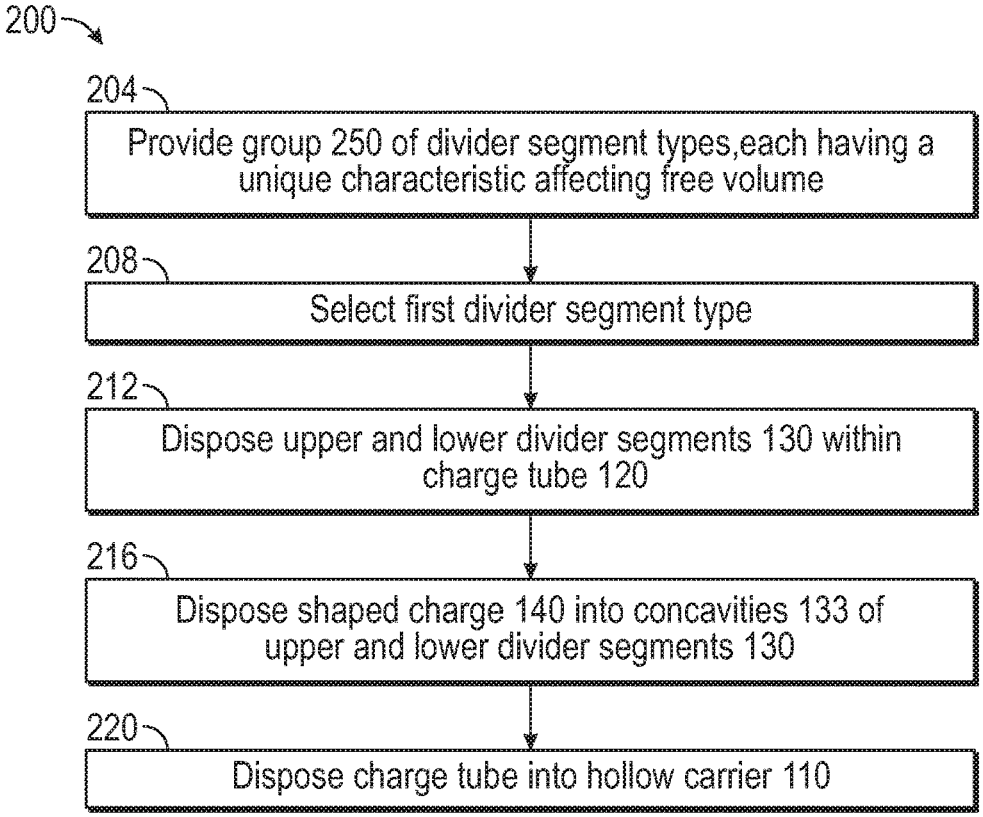
FIG. 18 is a flow chart of a method for selectively varying the free volume of the perforator of FIG. 1 according to an embodiment.

FIG. 18 is a flow chart of a method 200 for selectively varying the free volume of the perforator of FIG. 1 according to an embodiment. Referring primarily to FIGS. 10 and 16, at step 204, a group 250 of available divider segment 130 types is provided, each having a unique characteristic affecting the overall free volume of perforator 100. For example, the shape and size of concavities 133 may vary, thus providing differing volumes of shaped charge voids 152 about shaped charges 140 or providing differing angles $\alpha$ of circumferential support about shaped charge flanges 147 and concomitant different thicknesses of transverse voids 150. The overall thickness each divider segment 130 type may vary, thus providing a different volume of solid material. The material of divider segment 130 type may be varied, including varies metals, plastics, elastomers, and composite materials. Divider segment types may include divider segments 130 formed of stacked disks or plates 139. An almost limitless variety of divider segment 130 types is possible to allow the designer free reign in providing a low-debris, low interference modular perforator 100 of selectively variable free volume to match operational needs.

At step 208, from group 250 of available divider segment 130 types, a first divider segment type may be selected based on characteristics of the wellbore. At step 212, at least upper and lower divider segments 130 of the first divider segment type may be disposed within hollow charge tube 120 so that concavities in the bottom side of said upper divider segment and in the top side of the lower divider segment are radially aligned. Depending on the perforator 100, the number of divider segments may vary from as little as two to several hundred. Multiple types of divider segments 130 from group 250 may be provided within a given perforator 100.

At step 216, a shaped charge 140 may be disposed between concavity 133 in the bottom side of the upper divider segment 130 and concavity 133 in the top side of the lower divider segment 130. The outer circumference 147 of shaped charge 140 may be supported along less than 180 degrees by each divider segment 130 so as to form a transverse void 150 having a first axial thickness between the bottom side of the upper divider segment and the top side of the lower divider segment. At step 220, charge tube may be disposed within a debris tube 126, which in turn may be disposed within hollow carrier 110.

In summary, a method for providing a well perforator having selectively variable free volume has been described. Embodiments of a method for providing a well perforator having selectively variable free volume may generally include: Selecting a first divider segment type from a group of divider segment types each having a unique characteristic affecting free volume, each divider segment type defining a concavity in a top side and a cavity in a bottom side; disposing upper and lower divider segments of the first divider segment type within a hollow charge tube so that the concavity in the bottom side of the upper divider segment is radially aligned with the concavity in the top side of the lower divider segment; disposing a first shaped charge between the concavity in the bottom side of the upper divider segment and the concavity in the top side of the lower divider segment, an outer circumference of the first shaped charge being supported along less than 180 degrees by the upper divider segment, the outer circumference of the first shaped charge being supported along less than 180 degrees by the lower divider segment so as to form a first transverse void having a first axial thickness between the bottom side of the upper divider segment and the top side of the lower divider segment; and disposing the charge tube within a hollow carrier.

Any of the foregoing embodiments may include any one of the following elements or characteristics, alone or in combination with each other: The unique characteristic affecting free volume includes an overall thickness of each divider segment type; the group of divider segment types includes the first divider segment type defining a first overall thickness and a second divider segment type defining a second overall thickness; determining the first axial thickness of the first transverse void by selecting the first divider segment type; determining dimensions of a debris opening by the first axial thickness of the first transverse void; forming the debris opening through the a wall of the charge tube in communication with the first transverse void; disposing a debris guard between the charge tube and the hollow carrier so as to cover the debris opening; forming a relieving slot in the debris guard; the unique characteristic affecting free volume includes a shape of each concavity; the group of divider segment types includes the first divider segment type defining a first concavities shape and a second divider segment type defining a second concavity shape; a shaped charge void is defined between the concavity in the bottom side of the upper divider segment, the concavity in the top side of the lower divider segment, and the shaped charge; the unique characteristic affecting free volume includes a material forming each divider segment type; the group of divider segment types includes the first divider segment type having a first material and a second divider segment type having a second material; the unique characteristic affecting free volume includes a number of transverse voids formed by each adjacent pair of divider segments types selected from the group of divider segment types; an adjacent pair of the first divider segment types forms a single transverse void; an adjacent pair of the first divider segment types forms two transverse voids; an adjacent pair of the first divider segment types forms three transverse voids; the first divider segment type includes a plurality of disks; selecting a second divider segment type from the group of divider segment types; disposing upper and lower divider segments of the second divider segment type within the hollow charge tube; and disposing a second shaped charge between the upper and lower divider segments of the second divider segment type so as to form a second transverse void having a second axial thickness.

The Abstract of the disclosure is solely for providing the reader a way to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A method for providing a well perforator having selectively variable free volume, the method comprising:

selecting a first divider segment type from a group of divider segment types each having a unique characteristic affecting free volume, each divider segment type defining a concavity in a top side and a cavity in a bottom side;

disposing upper and lower divider segments of said first divider segment type within a hollow charge tube so that said concavity in said bottom side of said upper divider segment is radially aligned with said concavity in said top side of said lower divider segment;

disposing a first shaped charge between said concavity in said bottom side of said upper divider segment and said concavity in said top side of said lower divider segment, an outer circumference of said first shaped charge being supported along less than 180 degrees by said upper divider segment, said outer circumference of said first shaped charge being supported along less than 180 degrees by said lower divider segment so as to form a first transverse void having a first axial thickness between said bottom side of said upper divider segment and said top side of said lower divider segment; and disposing said charge tube within a hollow carrier.

2. The method for providing a well perforator of claim 1, wherein:

the unique characteristic affecting free volume includes an overall thickness of each divider segment type; and said group of divider segment types includes said first divider segment type defining a first overall thickness and a second divider segment type defining a second overall thickness.

3. The method for providing a well perforator of claim 2, further comprising:

determining said first axial thickness of said first transverse void by selecting said first divider segment type.

4. The method for providing a well perforator of claim 3, further comprising:

determining dimensions of a debris opening by said first axial thickness of said first transverse void; and forming said debris opening through said a wall of said charge tube in communication with said first transverse void.

5. The method for providing a well perforator of claim 4, further comprising:

disposing a debris guard between said charge tube and said hollow carrier so as to cover said debris opening.

6. The method for providing a well perforator of claim 4, further comprising:

forming a relieving slot in said debris guard.

7. The method for providing a well perforator of claim 1, wherein:

the unique characteristic affecting free volume includes a shape of each concavity; and said group of divider segment types includes said first divider segment type defining a first concavities shape and a second divider segment type defining a second concavity shape; whereby a shaped charge void is defined between said concavity in said bottom side of said upper divider segment, said concavity in said top side of said lower divider segment, and said shaped charge.

8. The method for providing a well perforator of claim 1, wherein:

the unique characteristic affecting free volume includes a material forming each divider segment type; and said group of divider segment types includes said first divider segment type having a first material and a second divider segment type having a second material.

9. The method for providing a well perforator of claim 1, wherein:

the unique characteristic affecting free volume includes a number of transverse voids formed by each adjacent pair of divider segments types selected from said group of divider segment types.

10. The method for providing a well perforator of claim 9, wherein:

an adjacent pair of said first divider segment types forms a single transverse void.

11. The method for providing a well perforator of claim 9, wherein:

an adjacent pair of said first divider segment types forms two transverse voids.

12. The method for providing a well perforator of claim 9, wherein:

an adjacent pair of said first divider segment types forms three transverse voids.

13. The method for providing a well perforator of claim 9, wherein:

said first divider segment type includes a plurality of disks.

14. The method for providing a well perforator of claim 9, further comprising:

selecting a second divider segment type from said group of divider segment types;

disposing upper and lower divider segments of said second divider segment type within said hollow charge tube; and disposing a second shaped charge between said upper and lower divider segments of said second divider segment type so as to form a second transverse void having a second axial thickness.

* * * * *